US006928763B2

(12) United States Patent
Zajk et al.

(10) Patent No.: US 6,928,763 B2
(45) Date of Patent: Aug. 16, 2005

(54) FIREARM CYLINDER INDEXING MECHANISM

(75) Inventors: Joseph J. Zajk, Newport, NH (US); Jeffrey R. Cornish, Newport, NH (US)

(73) Assignee: Sturm, Ruger and Company, Southport, CT (US)

( * ) Notice: Subject to any disclaimer, the term of this patent is extended or adjusted under 35 U.S.C. 154(b) by 0 days.

(21) Appl. No.: 10/663,490

(22) Filed: Sep. 15, 2003

(65) Prior Publication Data

US 2005/0055863 A1 Mar. 17, 2005

(51) Int. Cl.[7] ..... F41A 17/00
(52) U.S. Cl. ..... 42/59; 42/67
(58) Field of Search ..... 42/59, 67

(56) References Cited

U.S. PATENT DOCUMENTS

| | | | | |
|---|---|---|---|---|
| 2,472,326 A | | 6/1949 | Youker | 42/67 |
| 2,806,316 A | | 9/1957 | Ruger | 42/69 |
| 3,696,543 A | * | 10/1972 | Kennedy et al. | 42/67 |
| 3,738,042 A | | 6/1973 | Ruger et al. | 42/66 |
| 3,824,728 A | | 7/1974 | Kennedy | 42/66 |
| 4,219,954 A | * | 9/1980 | Brouthers | 42/67 |
| 4,307,530 A | | 12/1981 | Melcher et al. | 42/67 |
| 4,449,312 A | | 5/1984 | Ruger et al. | 42/66 |
| 6,385,888 B1 | | 5/2002 | Power | 42/65 |
| 6,397,506 B1 | | 6/2002 | Oglesby, Jr. | 42/89 |
| 2002/0078614 A1 | | 6/2002 | Kornberger | 42/59 |

OTHER PUBLICATIONS

Booklet D14 rev. Apr. 2002, Ruger® Vaquero® & Bisley Vaquero—Single Action Revolvers, Sturm, Ruger & Company, Inc.

* cited by examiner

*Primary Examiner*—J. Woodrow Eldred
(74) *Attorney, Agent, or Firm*—Morgan, Lewis & Bockius, LLP

(57) ABSTRACT

A mechanism for indexing the movement of a firearm cylinder to load and unload cartridges from a plurality of cartridge-receiving chambers in the cylinder. The firearm may generally comprise a cylinder, a supporting structure rotatably carrying the cylinder and a loading gate cutout. The indexing mechanism may comprise a cylinder indexing member, which in one embodiment may be a stop pin. The cylinder is configured to be stoppingly engaged by the indexing member when the cylinder is rotated in a first direction to align a cartridge-receiving chamber with the loading gate cutout in the frame, thereby creating an indexed position of the cylinder. Preferably, a plurality of indexed positions are created to allow each chamber to be aligned with the loading gate cutout for loading and unloading cartridges. In one embodiment, the cylinder is further freely rotatable in a second direction opposite the first direction without stopping engagement between the cylinder and indexing member. The mechanism may further include a pawl which is moveable into and out of engagement with the cylinder for advancing the cylinder as the firearm is discharged.

35 Claims, 9 Drawing Sheets

FIREARM CYLINDER INDEXING MECHANISM

BACKGROUND OF THE INVENTION

The present invention generally relates to cylinder mechanisms used in firearms, and more particularly to an improved mechanism that permits indexing of cylinders used in so-called "solid frame" revolvers.

Solid frame revolvers basically include a frame, a barrel secured to the front of the frame, a cylinder rotatably mounted in the frame and having a ratchet and a plurality of longitudinal chambers bored through the cylinder from its front end to rear end for receiving cartridges, a trigger pivotably mounted to the frame below the cylinder, and a hammer pivotably mounted to the frame behind the cylinder. Unlike other revolvers which pivot the cylinder assembly either upward or laterally out of the frame to give access to the cylinder chambers for loading or unloading, in solid frame revolvers a loading gate cutout in the rear of the frame provides access to the chambers for loading in cartridges through an openable/closeable loading gate. A cylinder pawl, which may be attached to the hammer, rotates the cylinder when the hammer is cocked or when the trigger is pulled. A cylinder latch is provided for preventing rotation of the cylinder when a cartridge is fired. The cylinder latch is configured to releasably engage a plurality of cylinder latch notches each corresponding to one of the cartridge receiving chambers. The cylinder latch engages each of the notches in succession as the cylinder is rotated.

One early approach used to load or unload cartridges in solid frame single action revolver designs originating in the 1800's is as follows. The hammer is pulled back rearward from its fully forward position to a "half cocked" loading notch position, which lowers the cylinder latch downward into the frame so that the cylinder can be freely rotated in a clockwise direction (when viewed from the vantage point of a user at the rear of the revolver). The loading gate is opened and the cylinder manually rotated counter-clockwise until it stops; the cylinder being reverse indexed in the counter-clockwise direction by the pawl which moves forward and upwards (from its rear and downwards position) when the hammer is "half-cocked" and engages the cylinder ratchet. A chamber is now precisely aligned with the loading gate frame cutout at the reverse index position of the cylinder, and a single cartridge may now be either inserted or removed from that chamber. When finished loading or unloading the desired number of cartridges into the cylinder of the revolver, the loading gate is closed. The hammer may now be moved forward and returned to its fully forward position, or pulled back fully rearward to a "full cocked" position if the revolver is ready to be fired.

Another approach used to load and unload cartridges in a newer solid frame revolver design as described in U.S. Pat. No. 4,307,530 eliminates the "half cocked" loading notch position and enhances convenience when loading or unloading the revolver. This design advantageously allows cartridges to be inserted or removed from cylinder chambers with the hammer in the fully forward "uncocked" position. Opening the loading gate lowers the cylinder latch downwards into the frame so that the cylinder can be freely rotated in a clockwise direction without "half cocking" the hammer. The cylinder is reverse indexed in the counter-clockwise direction by the pawl engaging the cylinder ratchet; however, no chamber is precisely aligned with the loading gate frame cutout when the cylinder stops at each reverse index position to allow a cartridge to be loaded or unloaded from the chamber. This is because the pawl is still in its rear and downwards position, and engages the cylinder ratchet at a different location than in the older single action revolver design discussed above. Additional manual manipulation of the cylinder by the user and time is required to precisely align each cylinder chamber with the loading gate frame cutout by sight. Such manual manipulation may be inconvenient and cumbersome to some users. Thus, there is a need for a solid frame revolver which can be more easily and rapidly loaded or unloaded with the hammer in the fully forward position, without the need to first "half-cock" the hammer.

SUMMARY OF THE INVENTION

The invention is generally directed to an improved cylinder indexing mechanism or apparatus for a firearm, which in a preferred embodiment is a revolver. In one embodiment, the revolver comprises a supporting structure, a cylinder rotatably carried by the supporting structure and having a plurality of cartridge-receiving chambers. A cylinder indexing member, preferably associated with and carried by the supporting structure, is provided for limiting the rotation of the cylinder. The cylinder has a front and a rear. The indexing member is engageable with the cylinder, and in one embodiment is preferably located behind the cylinder to engage the rear of the cylinder. In one embodiment, the indexing member is a stop pin which preferably is substantially cylindrical in shape. A cartridge loading gate cutout may be provided in the supporting structure through which cartridges are loaded and unloaded into and from the cylinder cartridge-receiving chambers.

The cylinder is configured to be engaged by the stop pin when the cylinder is rotated in a first direction, such that the rotation of the cylinder is restricted or limited in the first direction. Preferably, the cylinder has a limited range of rotation in the first direction such that the rotation of the cylinder is completely stopped when various predetermined positions of the cylinder are reached in relation to the supporting structure (described in more detail below). The rotation of the cylinder is preferably unrestricted or unlimited in a second direction opposite the first direction, such that the cylinder may be freely rotated in the second direction without being stoppingly engaged by the indexing member. Preferably, the first direction is counter-clockwise and the second direction is clockwise when viewed from the vantage point of a user at the rear of the revolver.

As used herein with respect to the rotational motion of the cylinder and when viewed from the vantage point of a user at the rear of the revolver, the "reverse" direction of cylinder rotation is defined as the counterclockwise direction in which cylinder rotation is restricted or limited by the indexing member. The "forward" direction of cylinder rotation is defined as the clockwise direction in which cylinder rotation is unrestricted or unlimited, and freely rotatable.

As used herein with respect to orientation using the revolver as a frame of reference to describe non-rotational direction, "forward" means towards the barrel end of the firearm and "rearward" means towards the handle or stock end of the firearm. "Downwards" means towards the bottom or underside of the firearm and "upwards" means towards the top of the firearm opposite the bottom or underside.

In the foregoing definitions and descriptions provided herein, any reference to either orientation or direction is intended primarily for the convenience in describing preferred embodiments of the invention and is not intended in any way to limit the scope of the present invention thereto.

In one embodiment, the supporting structure is a frame which may further comprise a cylinder frame and a grip frame; the grip frame supporting a handle for a user to hold the revolver. The indexing member may be disposed at least partially in a recess provided in the supporting structure. In one embodiment, the indexing mechanism is slidably moveable with respect to the cylinder.

A biasing member, such as a spring, may be provided in one embodiment which is associated with the indexing member. The spring may be disposed in the supporting structure recess and acts to bias the indexing member forward towards engagement with the cylinder. The spring provides a force that, in one embodiment, substantially maintains contact between the cylinder and indexing member as the cylinder is rotated in either or both the first and second directions. In another embodiment, the recess may further include a step and the indexing member may have a shoulder configured and adapted to engage the step, such that the indexing member is prevented from being ejected from the recess by the spring. Preferably, the spring is coiled around the indexing member. Numerous arrangements of the spring and indexing member are possible and the invention is not limited in this regard.

In another embodiment, the cylinder has a ratchet, preferably located on the back or rear of the cylinder, comprising a plurality of undulating surfaces for engaging the indexing member. In one embodiment, the undulating ratchet surfaces define a plurality of ratchet teeth that are engageable with the indexing member. The ratchet surfaces are configured and arranged on the ratchet to stoppingly engage the indexing member when the cylinder is rotated in the first direction described above, but not in the second direction. Preferably, at least one cartridge-receiving chamber of the cylinder may be stopped in alignment with the cartridge loading gate cutout for loading and unloading cartridges when the indexing member stoppingly engages the ratchet. More preferably, the ratchet surfaces are configured and arranged such that each cartridge-receiving chamber may be selectively aligned with the cartridge loading gate cutout, thereby defining a reverse cylinder rotation index position for each chamber.

In another embodiment in which the cylinder is configured with a plurality of undulating surfaces such as those formed by a ratchet comprising a plurality of teeth, the indexing member functions similarly to a spring-loaded reciprocating piston moving at least partially out of and back into the supporting structure recess (described above) in succession as the cylinder is rotated in the forward direction. The operation of the cylinder and indexing member will be more fully described below.

In one embodiment, the reverse indexing cylinder mechanism further comprises a pawl which is capable of selectively engaging the cylinder. Preferably, the pawl is located behind the cylinder and is selectively engageable with the back or rear of the cylinder. The pawl is moveable from a first position in which the cylinder is engageable with the pawl to a second position wherein the pawl is not engageable with the cylinder. In one embodiment, the pawl makes a pivotal movement about a pivot point in traveling between the first and second positions. Preferably, the pawl does not contact the frame when the pawl is in the first position. Also, preferably, the pawl contacts the cylinder supporting structure or frame to move the pawl into and hold the pawl in the second position. In one embodiment, the pawl has a lobe or other projection which projects from and extends outwards and downwards from the pawl to contact the frame when the pawl is in the second position. The lobe preferably projects from the bottom of the pawl and may be slightly rounded to promote smooth contact between the frame and pawl as the pawl is selectively and alternatingly moved into and out of contact with the frame between the first and second positions.

Preferably, the supporting structure or frame further comprises a cylinder frame for carrying the cylinder and a grip frame attachable to the cylinder frame. The grip frame may be attached to the bottom of cylinder frame and preferably has a substantially planar portion which is contacted by the pawl to move the pawl into and hold the pawl in the second position noted above. Also preferably, the lobe or projection of the pawl contacts the grip frame to move the pawl into and hold the pawl in the second position.

In one embodiment, the pawl may be mechanically linked or connected to the hammer (either directly or indirectly) whose operation also controls the position of the pawl in either the first or second positions describe above. Preferably, the pawl contacts the frame when the hammer is in a fully forward position (i.e., towards the cylinder and front of the revolver) to hold the pawl in the second position described above, wherein the pawl is not engageable with the cylinder. When the hammer is pulled rearwards from the fully forward position, the pawl and hammer are interconnected such that contact is broken between the pawl and frame. This releases the pawl allowing it to move forwards to engage the cylinder, in the first position described above. Preferably, the linkage or connection between pawl and hammer is arranged and configured such that the pawl moves upwards when the hammer is pulled back rearward from the fully forward position to release contact between the pawl and frame. In one embodiment, a pawl biasing member is provided which biases the pawl towards the cylinder. Thus, when contact is broken between the pawl and frame, the pawl is automatically moved forward by the biasing member to the first position into engagement with the cylinder. Preferably, the biasing member is a spring, such as a flat spring, helical spring, or other suitable type.

Subsequently moving the hammer back rearward from the fully forward position causes the pawl to contact the frame and move rearward out of engagement into the second position described above.

The pawl serves to advance the cylinder rotationally each time the trigger (mechanically linked to the hammer) is pulled to discharge the revolver.

In another embodiment, a cylinder indexing mechanism for a revolver comprises a frame having a cartridge loading gate cutout, a hammer pivotably mounted to the frame for firing the revolver, a cylinder rotatably carried and mounted in the frame and having a plurality of cartridge-receiving chambers, and a stop pin carried by the frame and being engageable with the cylinder. The cylinder is configured such that the stop pin engages and stops rotation of the cylinder when rotated in a first direction, thereby creating a rotational index position for the cylinder in relation to the supporting structure or frame. The index position is predetermined such that at least one of the cartridge-receiving chambers is aligned with the cartridge loading gate cutout in the frame. Preferably, a plurality of index positions is provided so that each chamber may be aligned with the loading gate cutout to load and unload cartridges. In another embodiment, the cylinder is configured such that the cylinder may be freely rotated in a second direction opposite the first direction without stopping engagement between the cylinder and stop pin. This allows the rotational position of the cylinder to be manipulated by the user and is also necessary to allow the cylinder to be properly advanced by the pawl each time after a round is discharged from the revolver, thereby bringing a new unfired cartridge into alignment with the hammer for firing.

BRIEF DESCRIPTION OF THE DRAWINGS

The features and advantages of the present invention will become more readily apparent from drawings of the preferred embodiments where like elements are labeled similarly, and in which.

DESCRIPTION OF THE PREFERRED EMBODIMENTS

Figure 1:
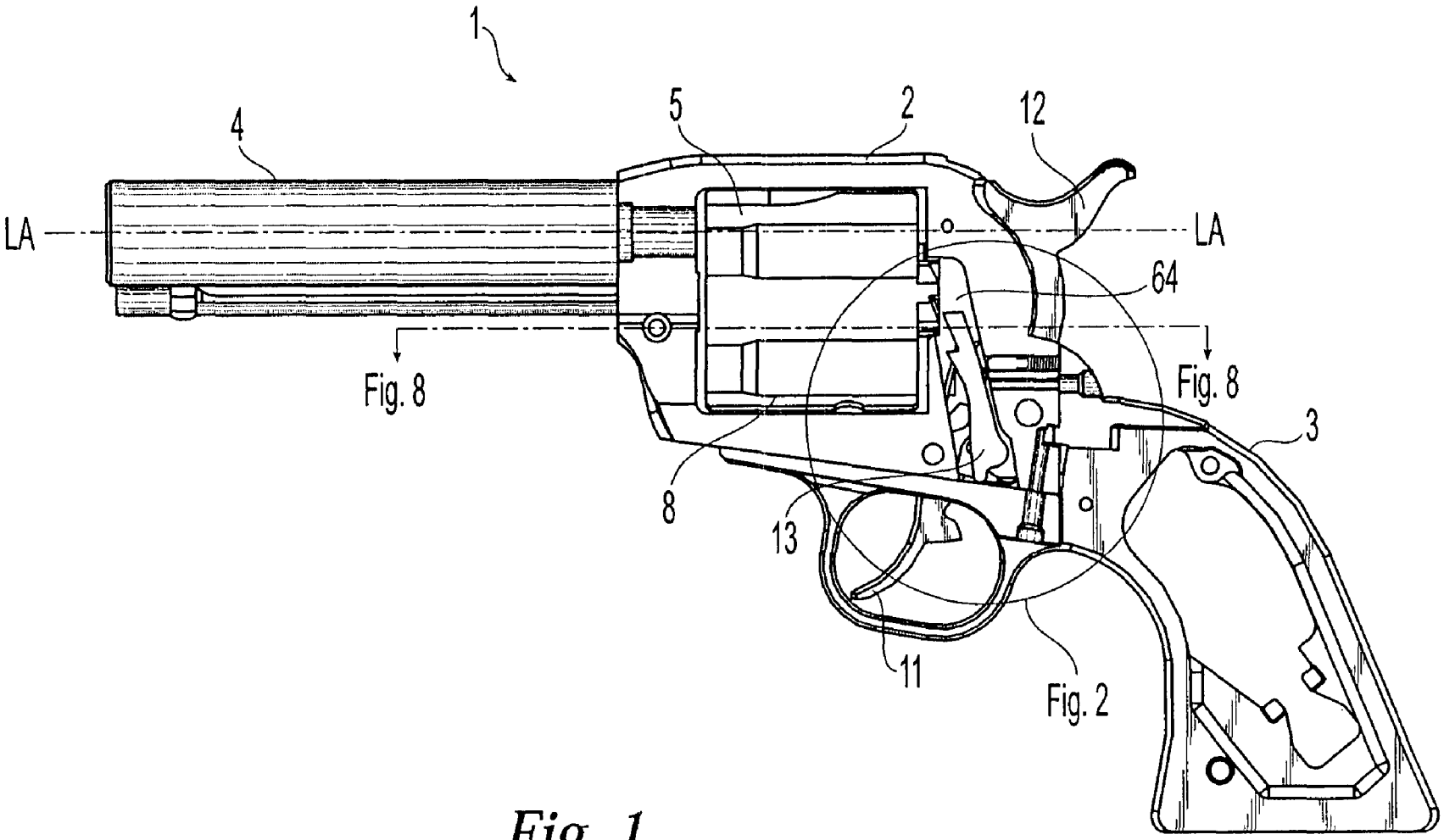
FIG. 1 is a side elevational view of a revolver of the present invention in which a portion of the exterior of the revolver is removed to reveal the rear of the cylinder and pawl.
Figure 2:
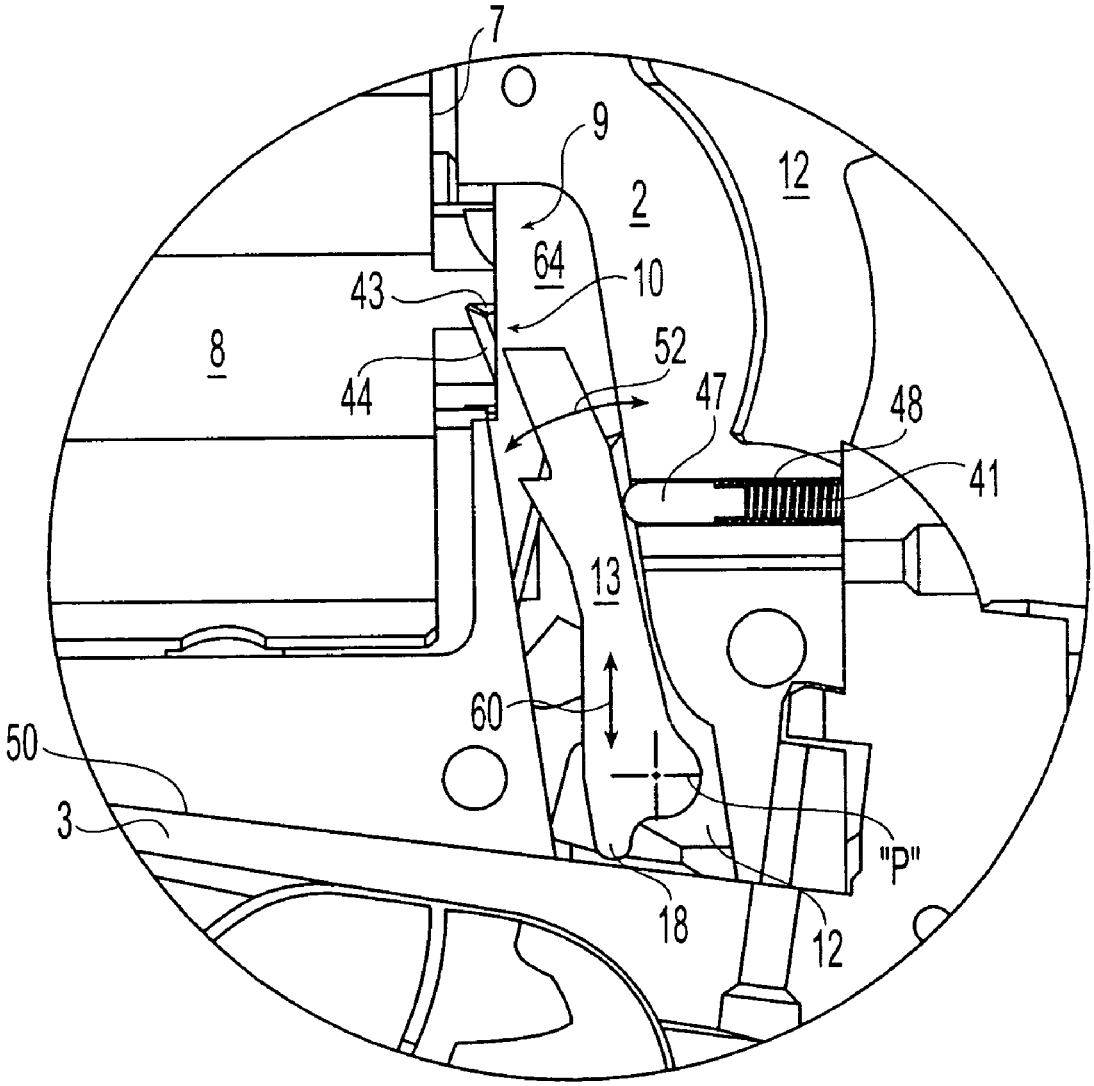
FIG. 2 is an enlarged view of detail 2 from FIG. 1 showing the rear of the cylinder and pawl.
Figure 3:
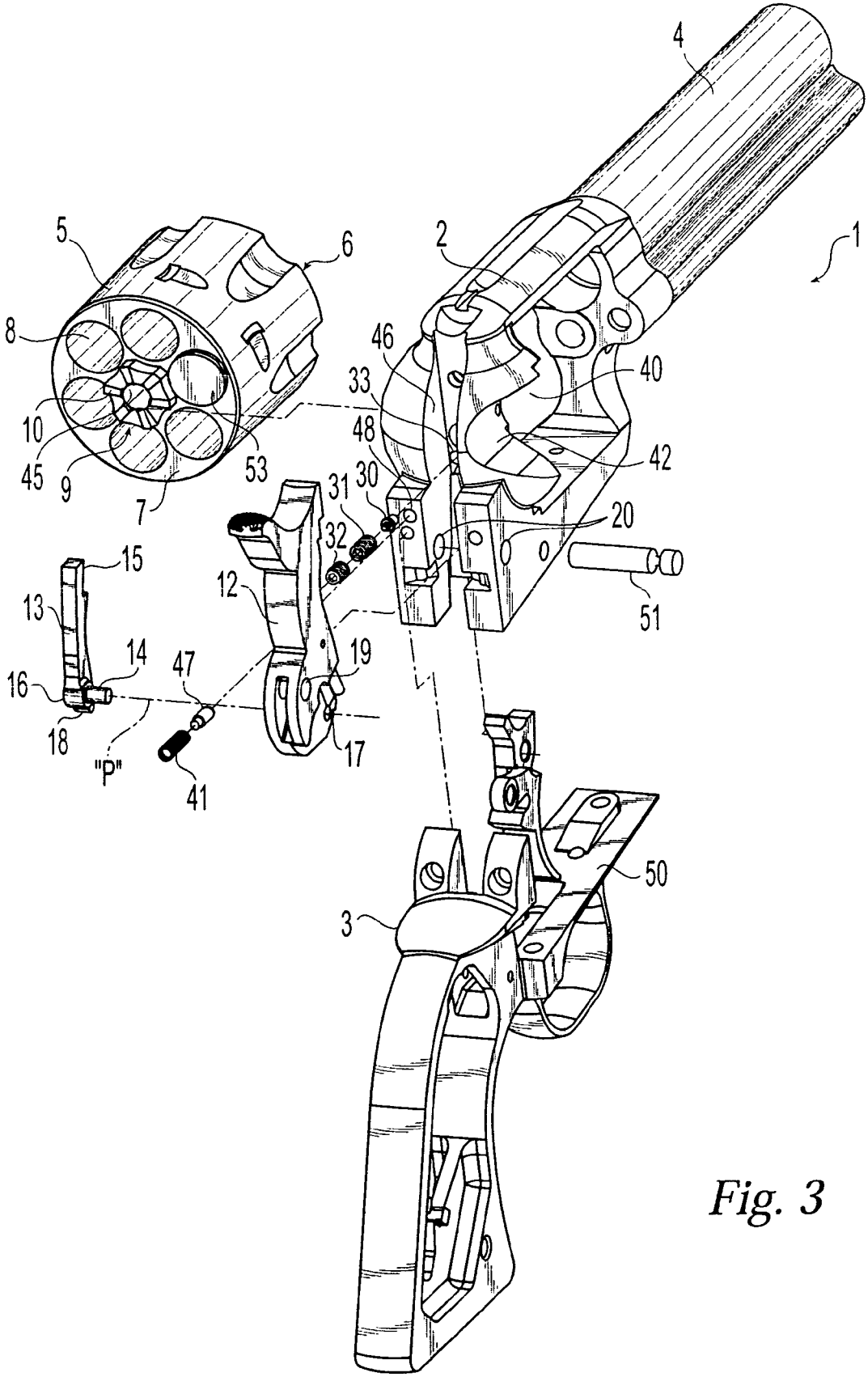
FIG. 3 is an exploded perspective view of the revolver of FIG. 1.
Figure 4:
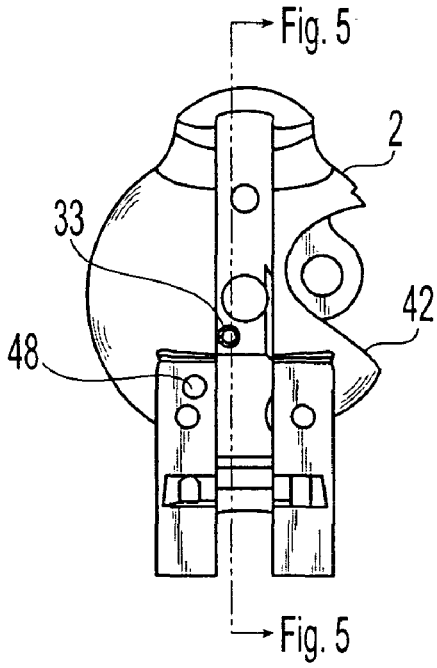
FIG. 4 is a rear elevational view of the cylinder frame of the revolver of FIG. 1.

Referring to FIGS. 1–3, a revolver 1 in one embodiment is shown as having a cylinder frame 2 and a grip frame 3 attachable to the cylinder frame 2. A longitudinally-extending barrel 4 is connected to the front of cylinder frame 2, and defines a longitudinal axis "LA" for revolver 1 coinciding with the centerline of the revolver. It should be noted that a single frame comprising cylinder and grip frames 2, 3, respectively, may be provided in lieu of a separate cylinder and grip frames. Cylinder frame 2 may comprise a pawl cavity 64 to accommodate pawl 13 disposed therein.

Preferably, grip frame 3 has a substantially planar portion or surface 50, as shown in FIGS. 2 and 3, onto which cylinder frame 2 may be mounted. In one embodiment, grip frame portion 50 defines a substantially planar surface to interact with and control the position of the pawl 13, as explained below. As shown in FIG. 3, cylinder frame 2 further comprises a loading gate frame cutout 42 which is typically covered by an openable/closeable loading gate 62 (shown in FIG. 8). The loading gate cutout 42 in cylinder frame 2 allows access to the cylinder for loading and unloading cartridges from the revolver 1.

A cylinder 5 has a front 6 and a back or rear 7, and a centrally-located hub 45 for receiving a pin (not shown) to rotatably mount cylinder 5 to cylinder frame 2. Cylinder 5 is rotatably mounted and carried in cylinder cavity 40 defined by cylinder frame 2, as shown. A plurality of cartridge-receiving chambers 8 are longitudinally bored through cylinder 5 for holding cartridges (the rear of a cartridge 53 is shown in FIG. 3 inserted into one of the cartridge-receiving chambers 8). Preferably, six such chambers 8 are provided.

A cylinder ratchet 9 is preferably disposed on the rear 7 of cylinder 5 for rotating the cylinder while the cylinder is carried in the cylinder frame 2. The ratchet 9 may comprise a plurality of undulating surfaces, such as teeth 10 best shown in FIG. 2, for engaging a cylinder indexing member, such as cylinder stop pin 30 described in more detail below. In one embodiment, ratchet teeth 10 may also be engaged by a pawl, as described more fully below.

A trigger 11 may be pivotably mounted in cylinder frame 2 and/or grip frame 3, and is generally positioned below cylinder 5 as shown in FIG. 1.

A hammer 12 is pivotably mounted preferably in cylinder frame 2 and located behind cylinder 5. In one embodiment, as shown, openings 19 in hammer 12 and corresponding openings 20 in cylinder frame 2 may be provided for pivotably connecting hammer 12 to cylinder frame 2. A hammer retaining pin 51 may be inserted through openings 19, 20 of hammer 12 and cylinder frame 2, respectively, to make the pivotable connection. Hammer 12 moves within slot 46 provided in cylinder frame 2. The hammer 12 is used to fire a round of ammunition, for example, by striking a firing pin (not shown) which in turn contacts a cartridge held in a cylinder chamber 8. The movement of the trigger 11 and hammer 12 may be linked together by a means commonly employed in the art and are employed together to fire the revolver 1.

A pawl 13 may be provided which comprises an upper portion 15 configured for engaging ratchet 9 and a lower portion 16. In one embodiment, pawl 13 is mechanically linked or connected to the hammer (either directly or indirectly) whose operation also controls the movement and position of the pawl (described above). Pawl 13 may be connected to hammer 12 via a cylindrical protrusion 14 which extends laterally outwards from the bottom portion 16 of pawl 13 and which is received in a corresponding opening 17 provided in hammer 12. The location of cylindrical protrusion 14 defines a pivot point "P" on the pawl 13 (see FIGS. 2 and 3). It should be noted that cylindrical protrusion 14 may formed as an integral part of pawl 13, or protrusion 14 may be a separate component which is attached to pawl 13 via shrink fitting, welding, threadable attachment, or other suitable means commonly employed in the art.

In one embodiment, as shown in FIG. 2 by directional arrow 52, pawl 13 is pivotally moveable in a generally forward and rearward direction around pivot point "P" such that pawl 13 may be brought into and out of engagement with the rear 7 of cylinder 5. Preferably, pawl 13 is also moveable in a generally upward and downward direction, as shown by directional arrow 60 in FIG. 2, such that pawl 13 may be brought into and out of contact with substantially planar portion or surface 50 of grip frame 3. Thus, in one embodiment, hammer 12 is configured and opening 17 is located in hammer 12 such that moving (i.e., pivoting) the hammer rearward from its fully forward position causes pawl 13 to correspondingly move in the upward or downward direction. The preferred operation and movement of pawl 13 will be described more fully below.

Pawl 13 is preferably biased in a forward direction towards cylinder 5 by a biasing member. In one embodiment, shown in FIG. 2 for example, the biasing member may be a pawl spring 41 which may in turn engage a pawl plunger 47 that contacts pawl 13 to bias the pawl forward.

The pawl spring 41 and plunger 47 are preferably housed in a pawl biasing member chamber 48 disposed in the cylinder frame 2.

Figure 6:
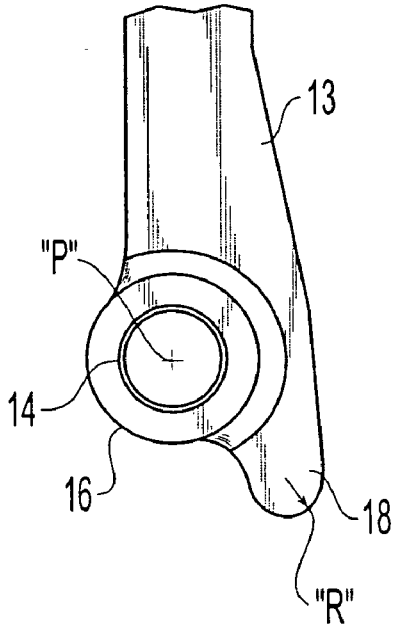
FIG. 6 is a side elevational view of the pawl of the revolver of FIG. 1.
Figure 11:
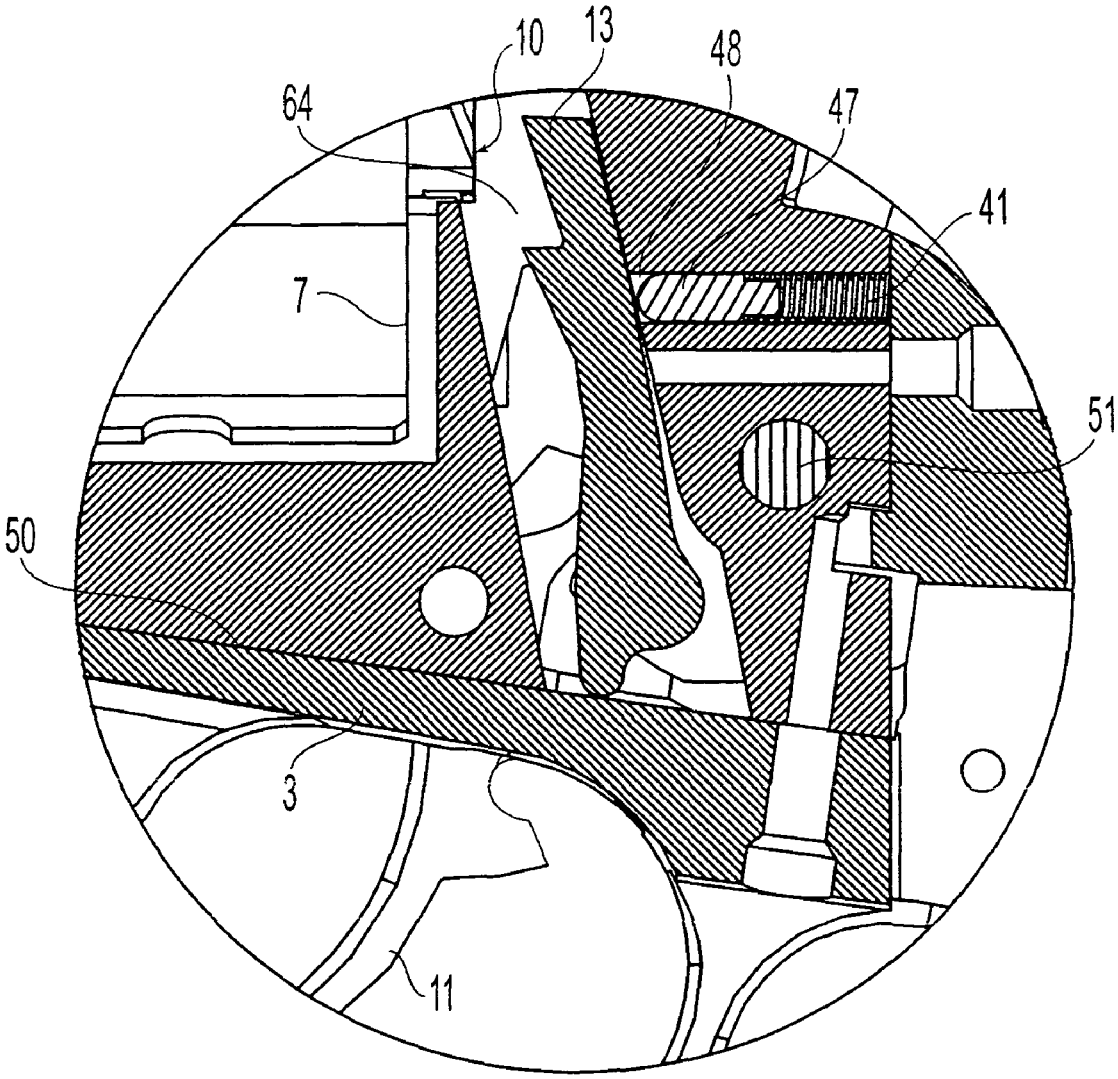
FIG. 11 is an enlarged side view of detail 11 from FIG. 10 showing the pawl.

As best seen in FIG. 6, the pawl 13 may have an outwardly extending projection or lobe 18, which preferably extends in a generally downward direction from lower portion 16 of pawl 13. In one embodiment, bottom projection 18 is designed to contact the substantially planar portion 50 of grip frame 3 below cylinder 5 (see FIG. 11) and acts to disengage pawl 13 from cylinder ratchet 9 and hold the pawl in a rearward disengaged position, as described in more detail below. Preferably, bottom projection 18 is configured as shown and located asymmetrically on pawl 13 with respect to pivot point "P" as shown. However, the shape of and placement of bottom projection 18 on pawl 13 is not limited in that regard, and other suitable configurations are possible as long as bottom projection 18 is capable of contacting substantially planar portion 50 of grip frame 3 sufficiently to disengage pawl 13 from ratchet 9. Bottom projection 18 may also have a rounded free end profile with a radius "R" as shown to facilitate smooth contact with grip frame 3.

Figure 5:
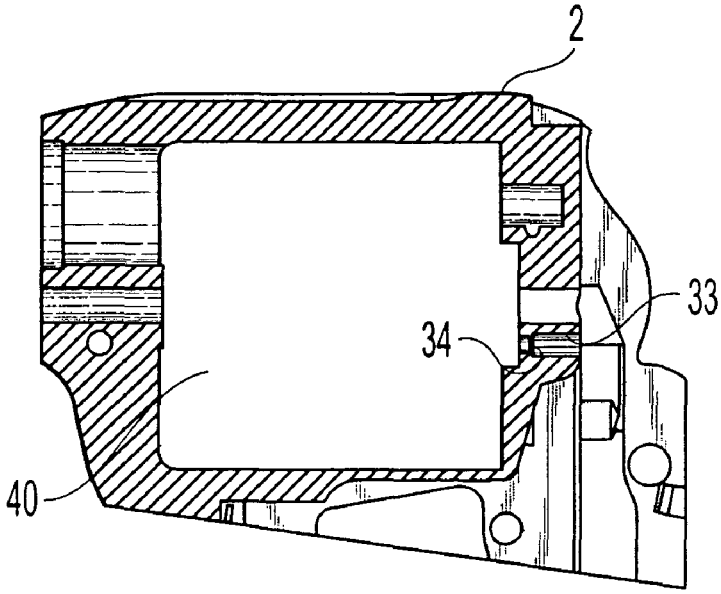
FIG. 5 is a side cross-sectional view along line 5—5 of FIG. 4.

With particular reference to FIGS. 3, 4, 5, 7 and 9, a cylinder indexing member such as cylinder stop pin 30 may be provided in one embodiment to engage cylinder 5. Preferably, cylinder 5 has a cylinder ratchet 9 disposed on the back 7 of the cylinder to engage stop pin 30. Stop pin 30 may carried by cylinder frame 2, and preferably is disposed in a stop pin recess or bore 33 formed in cylinder frame 2. In one embodiment as best seen in FIG. 3, recess 33 is provided within hammer slot 46 of the cylinder frame 2. Preferably, recess 33 is oriented in frame 2 such that stop pin 33 will be slidably moveable in a direction substantially parallel to the longitudinal axis "LA" of the revolver 1 and perpendicular to the rear or back 7 of cylinder 5. Preferably, stop pin 30 is inserted into recess 33 from the rear of cylinder frame 2 and protrudes forward from cylinder frame 2 into cylinder cavity 40 towards cylinder 5. Although stop pin recess 33 may extend completely through a portion of cylinder frame 2 as shown in FIG. 5, recess 33 may also be designed as a blind hole which extends only partially into cylinder frame 2 from the cylinder side.

Figure 9:
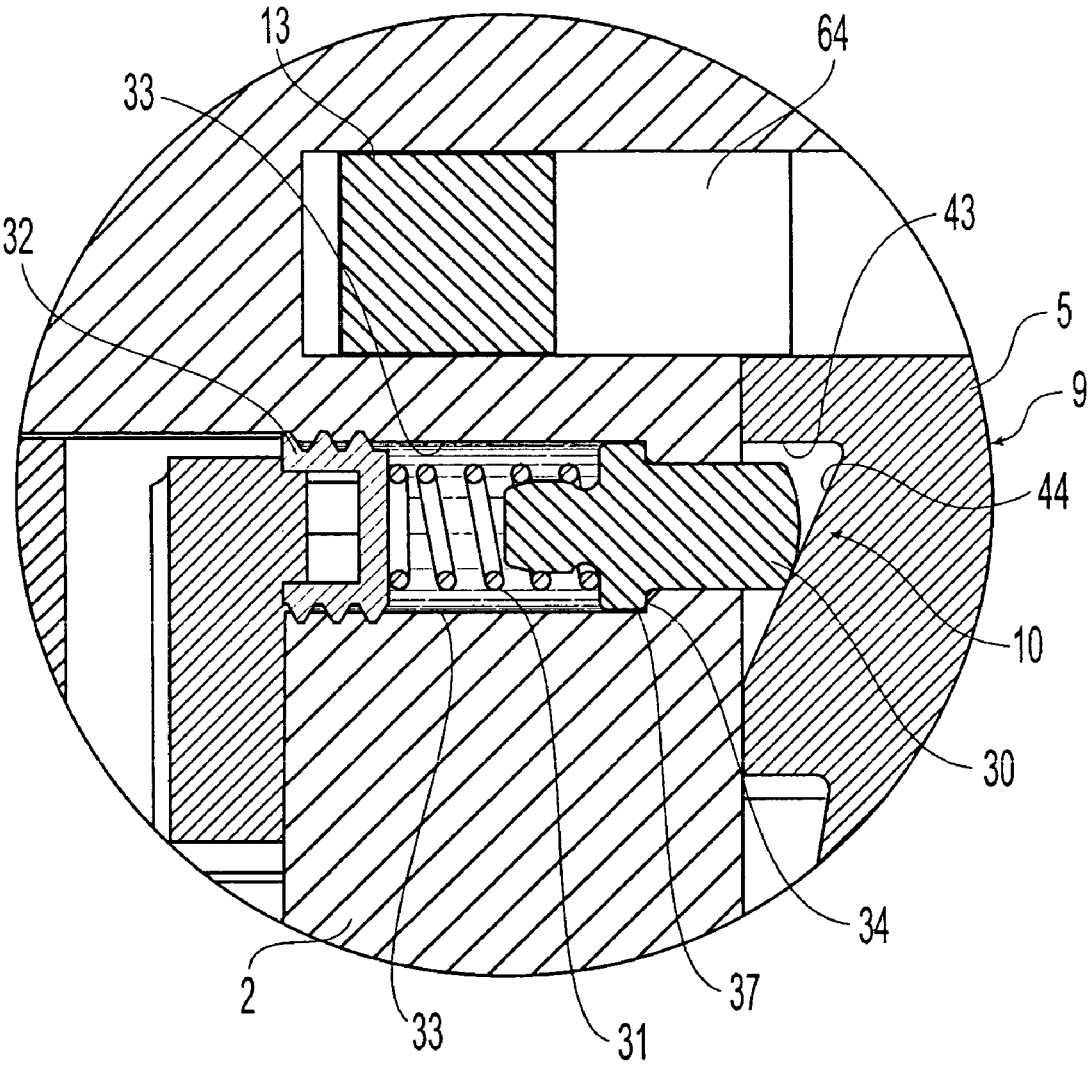
FIG. 9 is an enlarged top view of detail 9 from FIG. 8 showing in particular the stop pin.
Figure 10:
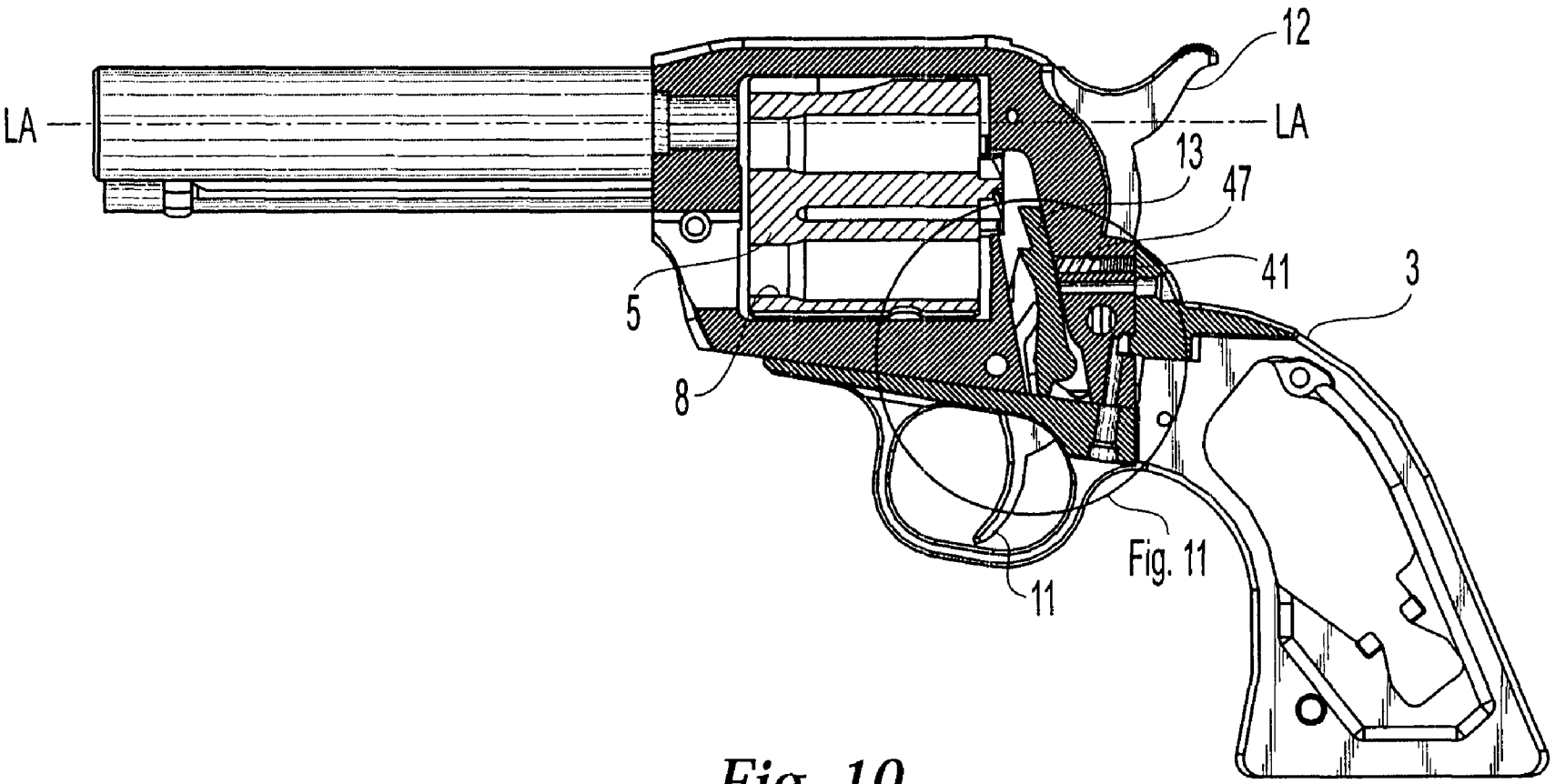
FIG. 10 is a side partial cross-sectional view along line 10—10 of FIG. 8 taken through the stop pin area of the revolver additionally showing the barrel.

Preferably, a biasing member, such as helical spring 31 best seen in FIGS. 3 and 9, is provided to bias stop pin 30 forward toward and into engagement with cylinder 5 and cylinder ratchet 9. In one embodiment, spring 31 is housed in recess 33 as shown. Spring 31 may substantially maintain contact between stop pin 30 and cylinder ratchet 9 as cylinder 5 is rotated in both a first direction and an opposite second direction. A set screw 32 (as shown) or other means may be provided to hold stop pin 30 and helical spring 31 in recess 33.

Figure 7:
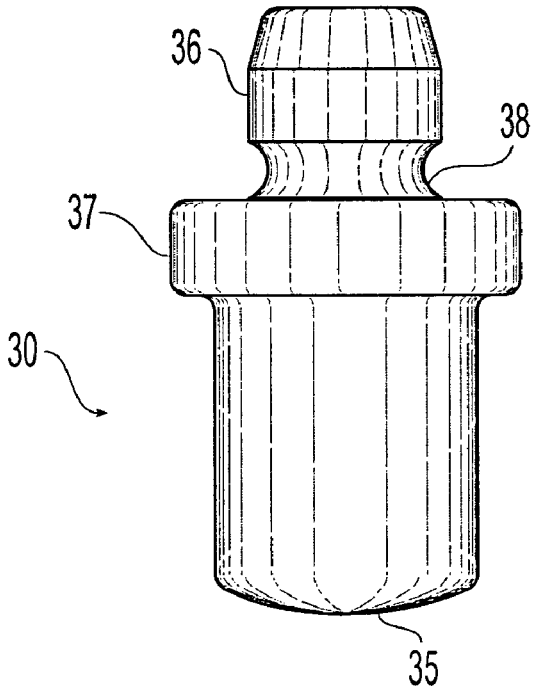
FIG. 7 is a side elevational view of the stop pin of the revolver of FIG. 1.

Preferably, stop pin 30 is configured as shown in FIG. 7 and comprises a cylinder ratchet engagement portion 35, a spring retention portion 36, and a shoulder 37 therebetween. Ratchet engagement portion 35 is configured and sized to engage the teeth 10 of cylinder ratchet 9, as discussed below. A circumferential groove 38 may also be provided as shown to assist in retaining one end of spring 31 on stop pin 30. Ratchet engagement portion 35 and shoulder 37 are preferably cooperatively configured and sized with stop pin recess 33 in cylinder frame 2 (best seen in FIG. 5) so that stop pin 30 protrudes by a predetermined amount into cylinder cavity 40 in frame 2. In one embodiment, cylinder frame recess 33 has a step 34 (see FIGS. 5 and 9) which engages shoulder 37 of stop pin 30 to limit the amount that stop pin 30 protrudes into cylinder cavity 40, and to keep spring 31 from ejecting stop pin 30 from the front of stop pin recess 33.

Cylinder ratchet 9 and ratchet teeth 10 are cooperatively configured and located with respect to stop pin 30 such that (i) stop pin 30 will not engage and catch teeth 10 when cylinder 5 is rotated in a forward (clockwise) direction, but (ii) stop pin 30 will engage and catch teeth 10 preferably in a plurality of rotational positions when cylinder 5 is rotated in an opposite reverse (counter-clockwise) direction, thereby forming a plurality of reverse indexing positions for cylinder 5. Preferably, the number of reverse indexing positions equals the number of cylinder chambers 8 such that each chamber has an associated reverse indexing position. Also preferably, the forward direction is clockwise and the reverse direction is counter-clockwise when reviewed from the vantage point of a user at the rear of revolver 1.

As shown in FIG. 2, each ratchet tooth 10 may be configured in typical fashion having a straight portion 43 (preferably oriented substantially perpendicular to the back or rear 7 of cylinder 5) and an inclined ramp portion 44 (preferably oriented at a suitable angle to the back or rear 7 of cylinder 5). Straight portion 43 and ramp portion 44 of teeth 10 are preferably arranged such that cylinder 5 may be freely rotated in the clockwise direction, but not in the counter-clockwise reverse indexing direction.

Cylinder stop pin 30 functions as follows. Preferably, the spring constant (k) of biasing member 31 is selected to maintain contact between cylinder stop pin 30 and cylinder ratchet 9 as cylinder 5 is rotated. In one embodiment, when cylinder 5 is rotated forward or clockwise (viewed from the vantage point of a user at the rear of revolver 1), stop pin 30 rides up and down over the ratchet teeth 10. Cylinder 5 is free to rotate in the clockwise direction as stop pin 30 rides up an down along successive passes of the inclined ramp portion 44 of the ratchet teeth 10 (see FIG. 9). Biasing member 31 allows stop pin 30 to maintain contact against cylinder ratchet 9, while concomitantly providing a reciprocating motion for pin 30, successively allowing stop pin 30 to at least partially project from and retract back into cylinder frame recess 33 as biasing member 31 becomes compressed and is then allowed to expand due to the configuration of the ratchet teeth 10. When cylinder 5 is rotated in a reverse or counter-clockwise direction, stop pin 30 catches one of the ratchet teeth 10 being abuttingly engaged by straight portion 43 of the teeth (see FIG. 9), thereby stopping the reverse rotation of cylinder 5. Thus, a reverse indexing position is formed by stop pin 30 independent from the functioning of pawl 13.

Figure 8:
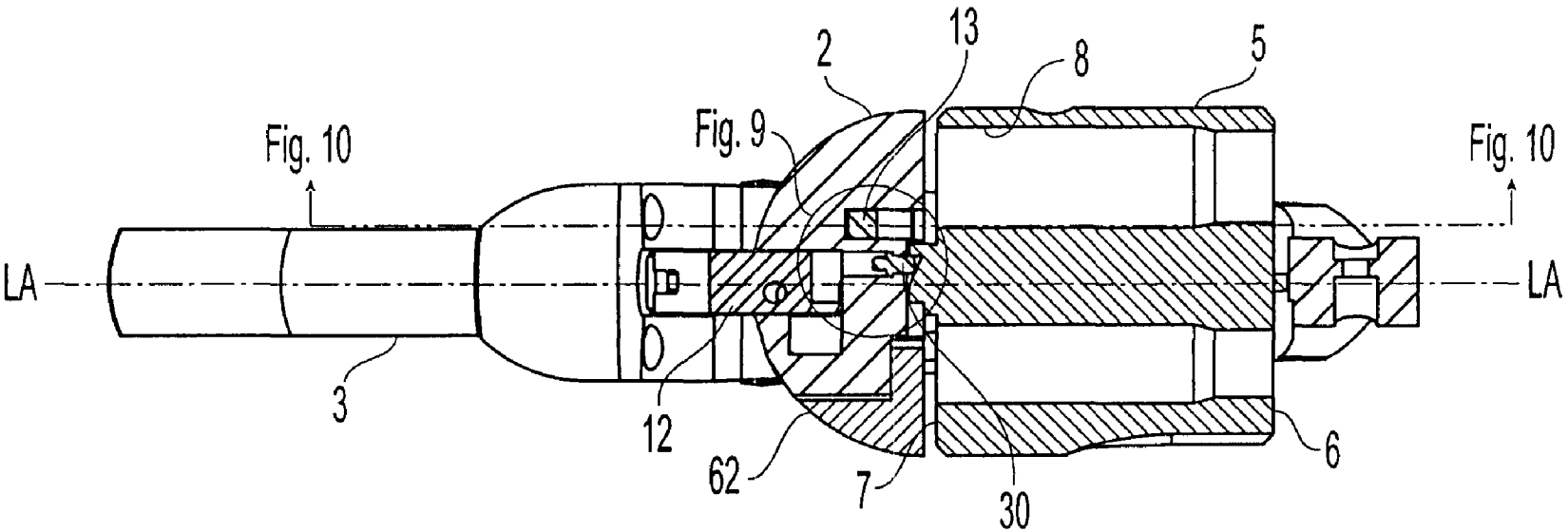
FIG. 8 is a top partial cross-sectional view along line 8—8 of FIG. 1.

In a preferred embodiment, stop pin 30 is located (but not limited to such a position) closer to the centerline of revolver 1 (coinciding with longitudinal axis "LA" as shown in FIG. 8) than pawl 13. This arrangement is best seen in FIG. 8 and FIG. 9 which is a closeup detail taken from FIG. 8. In this design, there is no interference between the pawl 13 or the stop pin 30 as both are free to independently engage different ratchet teeth 10 of cylinder 5. Preferably, stop pin 30 engages the rear of cylinder 5 near the bottom of cylinder ratchet 9 while pawl 13 engages cylinder ratchet 9 above the bottom along its side. It will be appreciated, however, that the location of stop pin 30 or pawl 13, and where each component engages cylinder 5, may be varied to that just described as a matter of design choice. Accordingly, the invention is not limited in this regard.

Operation of the reverse indexing cylinder mechanism in conjunction with loading or unloading the revolver I will now be described with reference to the preferred embodiment described herein, starting with hammer 12 in the fully forward position as shown in FIG. 1. In this example, the cylinder ratchet 9 is configured such that the cylinder 5 is freely rotatable in a forward clockwise direction (viewed from the vantage point of a user at the rear of revolver 1), but indexable in the reverse counter-clockwise direction. In the starting point with the hammer 12 in the fully forward position, bottom lobe 18 on pawl 13 is preferably engaged with the substantially planar portion 50 of grip frame 3, thereby holding pawl 12 rearwards against the force of pawl biasing member 41 and out of engagement with cylinder ratchet 9 (see, e.g., FIG. 11).

To load or unload a cartridge from the revolver 1, the loading gate (not shown) which covers the loading gate frame cutout 42 is opened with hammer 12 in the fully forward position. Cylinder 5 may be freely rotated in the forward clockwise direction (as described above) until the desired first cylinder chamber 8 is reached. If the first chamber 8 is not precisely aligned with the loading gate frame cutout 42 to load or unload a cartridge, cylinder 5 may be manually rotated in the reverse counter-clockwise direction until it stops; the cylinder reaching a first reverse index position associated with the first chamber 8 as one of the cylinder ratchet teeth 10 catches or engages cylinder stop pin 30 to stop the counter-clockwise rotation of cylinder 5. Stop pin 30 and cylinder ratchet 9 are cooperatively structured and arranged such that when a ratchet tooth 10 is engaged by pin 30, the first chamber 8 will be aligned with loading gate frame cutout 42 sufficient to allow a cartridge to be either inserted into or removed from the first chamber 8 through loading gate frame cutout 42. To access a second chamber 8 for loading or unloading a cartridge, cylinder 5 may continue to be manually rotated clockwise until the second chamber 8 comes into view through the loading gate frame cutout 42. If the user inadvertently rotates cylinder 5 clockwise too far past the point where the second chamber 8 is precisely aligned with loading gate frame cutout 42 to load or unload a cartridge, cylinder 5 may again be similarly rotated counter-clockwise in the same manner described above until a second reverse index position corresponding to the second chamber 8 (created by stop pin 30 engaging a ratchet tooth 10) is reached. The second chamber 8 and loading gate frame cutout 42 are now sufficiently aligned to load or unload the cartridge. The process may repeated for the third chamber 8 and subsequent other chambers in a similar fashion until the desired number of chambers 8 have been loaded or unloaded. The loading gate is then closed and the revolver 1 is readied for further action.

Accordingly, the present invention allows hammer 12 to remain in the "uncocked" position while aligning the cylinder chambers 8 with the loading gate cutout 42 of frame 2 to permit cartridges to be loaded or unloaded from the chambers. It should be noted that the cylinder chambers 8 need only be aligned with loading gate cutout 42 a sufficient degree to allow the unloading or loading of cartridges from the chambers. Completely perfect alignment of cylinder chambers 8 with loading gate 42 is not required.

Further describing the operation of the reverse cylinder indexing mechanism, the revolver's hammer 12 may next be pulled fully back rearward to a "full cock" position if the revolver is ready to fired. As the hammer 12 is pulled back rearward, pawl 12 concomitantly moves upwards (as indicated by directional arrow 60 in FIG. 2), thereby disengaging bottom lobe 18 from contact with grip frame 3, as shown in FIG. 2. Pawl 13 is now free to be moved forward (as indicated by directional arrow 52 in FIG. 2) by pawl biasing member 41 (via pawl plunger 47 interspersed therebetween) and into contact with the cylinder ratchet 9. Pawl 13 now engages cylinder ratchet 9 as required to advance the cylinder 5 as the revolver 1 is fired.

It should be noted that stop pin 30 preferably engages a ratchet tooth 10 at a position lower on cylinder 5 than the pawl 13, preferably near about the 6 o'clock position or bottom of the cylinder 5 (when viewed from the vantage point of a user at the rear of the revolver). By contrast, the pawl preferably engages the cylinder 5 near about the 9 o'clock position (when viewed from the vantage point of a user at the rear of the revolver). It should further be noted that stop pin 30 preferably maintains contact with ratchet 9 while pawl 13 is in a forward position in contact with ratchet 9 as described above.

When hammer 12 is ultimately returned to the forward position, pawl 13 moves back downwards (as indicated by directional arrow 60 in FIG. 2) in relation to the cylinder frame 2 and towards its original starting position described above. Bottom lobe 18 on pawl 13 is now forced back into contact with the substantially planar portion 50 of grip frame 3 again as pawl 13 moves downward, causing pawl 13 to pivotably move rearward against the force of pawl biasing member 41 and out of engagement with cylinder ratchet 9 (as indicated by directional arrow 52 in FIG. 2). The asymmetrical location of bottom lobe 18 on pawl 13 causes lobe 18 to act as a lever to pivot pawl 13 rearward when pawl 13 moves downward and contacts planar portion 50 of grip frame 3. The pawl 13 and hammer 12 have now been returned to their original starting position described above, and the pawl is in its rearward position again out of engagement with cylinder ratchet 9 shown in FIG. 11.

It will also be appreciated by those skilled in the art that the details of the indexing mechanism described herein are matter of design choice, and the invention is not limited to the particular embodiments described herein. Accordingly, numerous modifications and variations may be made to the indexing mechanism without departing from the spirit of the invention and scope of the claims appended hereto.

While the foregoing description and drawings represent the preferred embodiments of the present invention, it will be understood that various additions, modifications and substitutions may be made therein without departing from the spirit and scope of the present invention as defined in the accompanying claims. In particular, it will be clear to those skilled in the art that the present invention may be embodied in other specific forms, structures, arrangements, proportions, and with other elements, materials, and components, without departing from the spirit or essential characteristics thereof. One skilled in the art will appreciate that the invention may be used with many modifications of structure, arrangement, proportions, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being indicated by the appended claims, and not limited to the foregoing description.

Although the present invention is particularly applicable to revolvers, it should be understood that the is invention is not limited in that regard and may be used with any type of firearm, rifle, or weapon of any size having revolving chambers which are manually or automatically loaded with cartridges and/or ordnance.

What is claimed is:

1. A firearm having a cylinder-indexing mechanism comprising:

a frame;

a hammer pivotally movable from a first position engaged with the frame to a second position disengaged from the frame;

a cylinder rotatably mounted in the frame, the cylinder comprising a plurality of cartridge-receiving chambers and defining a loading position with respect to the frame for each chamber; and a stop pin engageable with the cylinder, the stop pin selectively stopping rotation of the cylinder in a first direction at each of the chamber loading positions when the hammer is engaged with the frame, the cylinder further being freely rotatable in a second direction when the hammer is engaged with the frame.

2. The firearm of claim 1, further comprising a pawl selectively engageable with the cylinder and moveable from a first position wherein the pawl engages the cylinder to a second position wherein the pawl does not engage the cylinder.

3. The firearm of claim 2, further comprising the pawl contacting the frame to hold the pawl in the second position.

4. The firearm of claim 3, further comprising the pawl having a lobe projecting outwardly therefrom which contacts the frame.

5. The firearm of claim 3, further comprising the hammer pivotably mounted to the frame for discharging the revolver, the hammer connected to the pawl such that moving the hammer alters the position of the pawl, wherein the pawl contacts the frame when the hammer is in a fully forward position to hold the pawl in the second position.

6. The firearm of claim 5, wherein moving the hammer rearward from the fully forward position releases contact between the pawl and frame to allow the pawl to engage the cylinder in the first position.

7. The firearm of claim 6, wherein the pawl is configured to move upwards to release contact between the pawl and frame when the hammer is moved rearward from the fully forward position.

8. The firearm of claim 2, further comprising a biasing member biasing the pawl towards the cylinder.

9. The firearm of claim 1, further comprising the frame having a cartridge loading gate cutout, wherein the stop pin stoppingly engages the cylinder in the first rotational direction such that at least one of the cartridge-receiving chambers is aligned with the cartridge loading gate cutout in the frame.

10. The firearm of claim 1, further comprising a biasing member associated with the stop pin to keep the stop pin biased towards the cylinder.

11. The firearm of claim 10, wherein the stop pin is slidably moveable with respect to the cylinder.

12. The firearm of claim 10, further comprising at least a portion of the stop pin and the biasing member being disposed in the frame.

13. The firearm of claim 1, further comprising the cylinder including a ratchet having a plurality of teeth for engaging the stop pin.

14. The firearm of claim 13, further comprising the teeth each being configured to stoppingly engage the stop pin in the first direction but not in the second rotational direction opposite the first direction.

15. The firearm of claim 1, wherein the frame further comprises a cylinder frame for carrying the cylinder and a grip frame attachable to the cylinder frame.

16. The firearm of claim 1, wherein when viewed from the perspective of the user the first direction is counter-clockwise and the second direction is clockwise.

17. A firearm having a cylinder indexing mechanism comprising:

a frame;

a hammer pivotally movable from a first position engaged with the frame to a second position disengaged from the frame;

a cylinder rotatable carried by the frame and having a front, a rear, and a plurality of cartridge-receiving chambers, the cylinder defining a loading position with respect to the frame for each chamber;

a pawl engageable with the cylinder; and a cylinder indexing member carried by the frame and engageable with the rear of the cylinder;

wherein with the hammer engaged with the frame, the cylinder is configured to be stoppingly engaged by the indexing member in each of the loading positions when the cylinder is rotated in a first direction and the cylinder is freely rotatable without being stoppingly engaged by the indexing member when the cylinder is rotated in a second direction opposite the first direction.

18. The firearm of claim 17, further comprising the cylinder having a ratchet comprising a plurality of undulating surfaces for engaging the indexing member.

19. The firearm of claim 18, wherein the surfaces are arranged on the ratchet to engage the indexing member such that at least one of the cartridge-receiving chambers may be stopped in alignment with a cartridge loading gate cutout in the supporting structure.

20. The firearm mechanism of claim 17, wherein the cylinder indexing member is a pin having a substantially cylindrical shape.

21. The firearm of claim 18, further comprising the indexing member being disposed at least partially in a recess in the supporting structure.

22. The firearm of claim 21, further comprising a spring associated with the indexing member, the spring being disposed in the supporting structure recess and biasing the indexing member forward towards the cylinder.

23. The firearm of claim 22, further comprising the recess having a step and the indexing member having a shoulder configured and adapted to engage the step such that the indexing member is prevented from being ejected from the recess by the spring.

24. The firearm of claim 17, further comprising the pawl being located behind the cylinder and having a biasing member to bias the pawl towards the rear of the cylinder for engagement therewith;

wherein the pawl is movable from: (i) a first position in which the pawl is engageable with the cylinder to (ii) a second position in which the pawl is not engageable with the cylinder.

25. The firearm of claim 24, further comprising the pawl having a projection extending outwardly therefrom to contact the supporting structure, the projection contacting the frame to hold the pawl in the second position.

26. A firearm having indexed movement of a revolver cylinder, the firearm comprising:

a frame;

a hammer pivotably mounted to the frame and movable into and out of engagement with the frame;

a cylinder rotatably carried by the frame and having a front and a rear, the cylinder comprising a plurality of cartridge-receiving chambers and defining a loading position with respect to the frame for each of the cylinders;

a ratchet disposed on the rear of the cylinder;

a pawl pivotably mounted to the hammer and engageable with the cylinder ratchet, at least a portion of the pawl capable of contacting the frame; and a stop pin carried by the frame and engageable with the cylinder ratchet, the ratchet and stop pin being cooperatively adapted and configured such that the stop pin is capable of selectively engaging and stopping the rotation of the cylinder in a first direction at each of the loading positions when the hammer is engaged with the frame.

27. The firearm of claim 26, wherein the ratchet is configured to permit the cylinder to be freely rotated in a second direction opposite the first direction.

28. The firearm of claim 26, further comprising the pin being biased towards the cylinder ratchet by a biasing member.

29. The firearm of claim 28, wherein the biasing member and at least part of the pin are disposed in a recess in the frame.

30. The firearm of claim 26, wherein the pawl is moveable from:

(i) a first position in which the pawl is not in contact with the frame and engaged with the cylinder; to (ii) a second position in which the pawl is in contact with the frame and does not engage the cylinder.

31. The firearm of claim 30, wherein the pawl is mounted to the hammer such that the pawl moves upwards when moved from the second position to the first position.

32. The firearm of claim 3, wherein the frame further comprises a cylinder frame for carrying the cylinder and a grip frame attachable to the cylinder frame, the pawl contacting the grip frame to hold the pawl in the second position.

33. The firearm of claim 32, further comprising the pawl having a lobe projecting outwardly therefrom which contacts the frame.

34. A solid-frame revolver comprising:

a barrel;

a frame connected to the barrel and having a loading gate cutout;

a cylinder rotatably carried by the frame and defining a plurality of cartridge-receiving chambers;

a ratchet disposed on the cylinder;

a hammer pivotally mounted to the frame and movable from an uncocked forward position engaged with the frame to a cocked rearward position disengaged from the frame;

a pawl operably connected to the hammer and engageable with the ratchet, the pawl movable from a first position in which the pawl is not engaged with the ratchet when the hammer is uncocked, to a second position in which the pawl engages the ratchet when the hammer is cocked; and an indexing member biased into engagement with the ratchet and stopping rotation of the cylinder in a first direction when the hammer is uncocked to selectively locate each of the chambers in alignment with the loading gate cutout in the frame for loading or unloading cartridges, the indexing member allowing free rotation of the cylinder in a second direction when the hammer is uncocked.

35. A revolver comprising:

a frame having a cartridge loading gate cutout;

a hammer pivotally mounted to the frame and movable from a forward position engaged with the frame to a rearward position disengaged from the frame;

a trigger pivotally mounted to the frame;

a cylinder rotatably carried by the frame and defining a plurality of chambers to receive cartridges, the cylinder freely rotatable in one direction with the hammer in the forward position engaged with the frame, the cylinder defining a loading position for each of the chambers with respect to the loading gate cutout in the frame;

a pawl selectively engageable with the cylinder and moveable from a first position engaging the cylinder to a second position disengaged from the cylinder; and a means for indexing the cylinder in a second opposite rotational direction with the hammer in the forward position engaged with the frame to align a chamber in a loading position with the loading gate cutout in the frame.

* * * * *